US006808604B1

(12) United States Patent
Goto et al.

(10) Patent No.: US 6,808,604 B1
(45) Date of Patent: Oct. 26, 2004

(54) DISCHARGE SURFACE TREATMENT ELECTRODE, MANUFACTURING METHOD THEREOF AND DISCHARGE SURFACE TREATING METHOD

(75) Inventors: Akihiro Goto, Tokyo (JP); Toshio Moro, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/049,311

(22) PCT Filed: Sep. 30, 1999

(86) PCT No.: PCT/JP99/05363

§ 371 (c)(1),
(2), (4) Date: Feb. 12, 2002

(87) PCT Pub. No.: WO01/23640

PCT Pub. Date: Apr. 5, 2001

(51) Int. Cl.[7] ..... H05F 3/00

(52) U.S. Cl. ..... 204/164; 204/291; 204/294; 204/280; 219/69.13; 219/69.14; 219/69.15; 219/69.17; 219/69.2; 422/186.03; 427/580

(58) Field of Search ..... 219/69.13, 69.15, 219/69.17, 69.2, 69.14; 427/580; 204/164, 280, 291, 294; 422/186.03

(56) References Cited

U.S. PATENT DOCUMENTS 5,434,380 A * 7/1995 Magara et al. ..... 219/69.13
5,651,901 A * 7/1997 Mohri et al. ..... 219/69.17

FOREIGN PATENT DOCUMENTS

| | | |
|---|---|---|
| JP | 5-148615 | 6/1993 |
| JP | 8-300227 | 11/1996 |
| JP | 9-192937 | 7/1997 |
| JP | 10-130318 | 5/2001 |

OTHER PUBLICATIONS

Formation of hard layer metallic material by EDM, Proceedings of ISEM12 (1998) 271–278.

* cited by examiner

*Primary Examiner*—Bruce F. Bell
(74) *Attorney, Agent, or Firm*—Sughrue Mion, PLLC

(57) ABSTRACT

WC powder (11) and W powder (12) are mixed and entered in a press mold and compressed and molded, thereby forming a discharge surface treatment electrode (10). Discharge is caused to occur between the discharge surface treatment electrode (10) and a workpiece (16) by a discharge surface treatment power unit (17), whereby a component of the discharge surface treatment electrode (10) melted by discharge heat is deposited on the workpiece (16). W, a component of the discharge surface treatment electrode (10), reacts with C, a component of work liquid (4), to produce WC and together with the WC which is a component of the discharge surface treatment electrode (10) a hard film (20) made of WC is formed on the workpiece (16). The hardness and strength of the hard film formed on the workpiece (16) by the discharge surface treatment can be enhanced.

7 Claims, 7 Drawing Sheets

DISCHARGE SURFACE TREATMENT ELECTRODE, MANUFACTURING METHOD THEREOF AND DISCHARGE SURFACE TREATING METHOD

TECHNICAL FIELD

This invention relates to improvements in a discharge surface treatment electrode and a manufacturing method thereof and a discharge surface treatment method used for discharge surface treatment for causing discharge to occur between the electrode and a workpiece and forming a hard film made of electrode material on the workpiece surface by the discharge energy or a hard film made of a substance resulting from the electrode material reacting with by the discharge energy on the workpiece surface.

BACKGROUND OF THE INVENTION

Hitherto, a discharge surface treatment method, for example, disclosed in JP-A-5-148615 has been available as an art of forming a hard film on a workpiece surface for providing corrosion resistance and abrasion resistance. This art provides a discharge surface treatment method of metal material consisting of two steps of performing primary working (laying-up working) using a compacted powder electrode of a discharge surface treatment electrode comprising WC (tungsten carbide) powder and Co (cobalt) powder mixed and compressed and molded and then replacing the electrode with an electrode comparatively less quickly consumed such as a copper electrode and performing secondary working (re-melt working). This method can form a hard film having strong adhesion to a copper material, but is difficult to form a hard film having strong adhesion to a sintered material such as a hard alloy.

However, our study finds out that if a material for forming hard carbide such as Ti (titanium) is used as a discharge surface treatment electrode and discharge is caused to occur between the electrode and a metal material of a workpiece, a hard film can be formed on the metal surface of the workpiece without a re-melt step. The reason why a strong hard film can be formed is that with the discharging, the consumed electrode material and C (carbon) of a component of work liquid react with each other to produce TiC (titanium carbide). It is also found out that if discharge is caused to occur between a compacted powder electrode of a discharge surface treatment electrode made of metal hydride such as TiH2 (titanium hydride) and a metal material of a workpiece, a hard film can be formed more rapidly and with higher adhesion as compared with the case where Ti etc. is used as the material. Further, it is found out that if discharge is caused to occur between a compact powder electrode of a discharge surface treatment electrode comprising any other metal or ceramics mixed with hydride such as TiH2 and a metal material of a workpiece, a hard film having various properties of hardness, abrasion resistance, etc., can be formed more quickly.

Such a method is disclosed, for example, in JP-A-192937/1997. A configuration example of a discharge surface treatment electrode and an apparatus used for such discharge surface treatment will be discussed with reference to FIG. 7. In the figure, numeral 1 denotes a compacted powder electrode of a discharge surface treatment electrode comprising TiH2 powder compressed and molded, numeral 2 denotes a workpiece, numeral 3 denotes a work tank, numeral 4 denotes work liquid, numeral 5 denotes a switching element for switching voltage and current applied to the compact powder electrode 1 and the workpiece 2, numeral 6 denotes a control circuit for controlling turning on/off the switching element 5, numeral 7 denotes a power supply, numeral 8 denotes a resistor, and numeral 9 denotes a formed hard film. According to such a configuration, discharge is caused to occur between the compact powder electrode 1 and the workpiece 2 and the hard film 9 can be formed by the discharge energy on the surface of the workpiece 2 made of steel, a hard alloy, etc.

Such formation of a hard film made of carbide, etc., on a workpiece by discharge surface treatment is executed by forming a film of carbide on the workpiece by heat energy of discharge using the carbide which becomes the component of the hard film to be formed as a component of the discharge surface treatment electrode or by using metal containing the carbide which becomes a component of the hard film to be formed or a compound of that metal as the component of the discharge surface treatment electrode and causing the metal or the metal compound to react with a component of work liquid, C, by heat energy of discharge to form a hard film made of carbide on the workpiece.

Here, if the component of the discharge surface treatment electrode is only a material having comparatively high hardness such as carbide, powder of the discharge surface treatment electrode component cannot be fixed by compression molding of press and thus usually a material having comparatively low hardness is mixed as a binder. However, if Co (cobalt), etc., used as a binder to manufacture a sintered alloy, etc., is mixed as an electrode material, it is a material not producing carbide and thus the hardness of a hard film formed on a workpiece becomes low and the material cannot be used for such application where high abrasion resistance is required; this is a problem. Some materials in the hard film formed on the workpiece may be poor in compatibility with the base material of the workpiece and in such a case, there is a problem of weakening the adhesive strength of the hard film.

DISCLOSURE OF THE INVENTION

It is an object of the invention to solve the above-mentioned problems and provide a discharge surface treatment electrode and a manufacturing method thereof and a discharge surface treatment method capable of enhancing the hardness and strength of a hard film formed on a workpiece by discharge surface treatment.

According to the invention, there is provided a discharge surface treatment electrode used for discharge surface treatment causing discharge to occur between the electrode and a workpiece in work liquid containing carbon and forming a hard film containing metal carbide as a component on the surface of the workpiece by discharge energy, wherein the metal carbide and metal contained in the metal carbide or a compound of that metal or any other metal forming the hard carbide or a compound of that metal are contained as material of the discharge surface treatment electrode.

The metal carbide is metal carbide of metal or a metal compound contained in material of the workpiece.

The material of the discharge surface treatment electrode contains WC and W.

According to the invention, there is provided a manufacturing method of a discharge surface treatment electrode used for discharge surface treatment causing discharge to occur between the electrode and a workpiece in work liquid containing carbon and forming a hard film containing metal carbide as a component on a surface of the workpiece by discharge energy, wherein powder of the metal carbide and powder of metal contained in the metal carbide or powder of a compound of the metal or powder of any other metal forming hard carbide or powder of a compound of the metal are mixed and are compressed and molded to form the discharge surface treatment electrode.

Wax is added to the material of the discharge surface treatment electrode and then they are compressed and molded and are heated at a temperature at least as high as that at which the wax is melted and no higher than the temperature at which the wax is decomposed to produce soot, for evaporating and removing the wax to form the discharge surface treatment electrode.

According to the invention, there is provided a discharge surface treatment method for causing discharge to occur between a discharge surface treatment electrode and a workpiece in work liquid containing carbon and forming a hard film containing metal carbide as a component on the surface of the workpiece by discharge energy, wherein a discharge surface treatment electrode containing the metal carbide and metal contained in the metal carbide or a compound of that metal or any other metal forming hard carbide or a compound of that metal is used.

The metal carbide is metal carbide of metal or a metal compound contained in material of the workpiece.

The invention is configured as described above and thus has the advantage that the hardness and strength of a hard film formed on a workpiece by the discharge surface treatment can be enhanced.

BEST MODE FOR CARRYING OUT THE INVENTION

Embodiment 1

Figure 1:
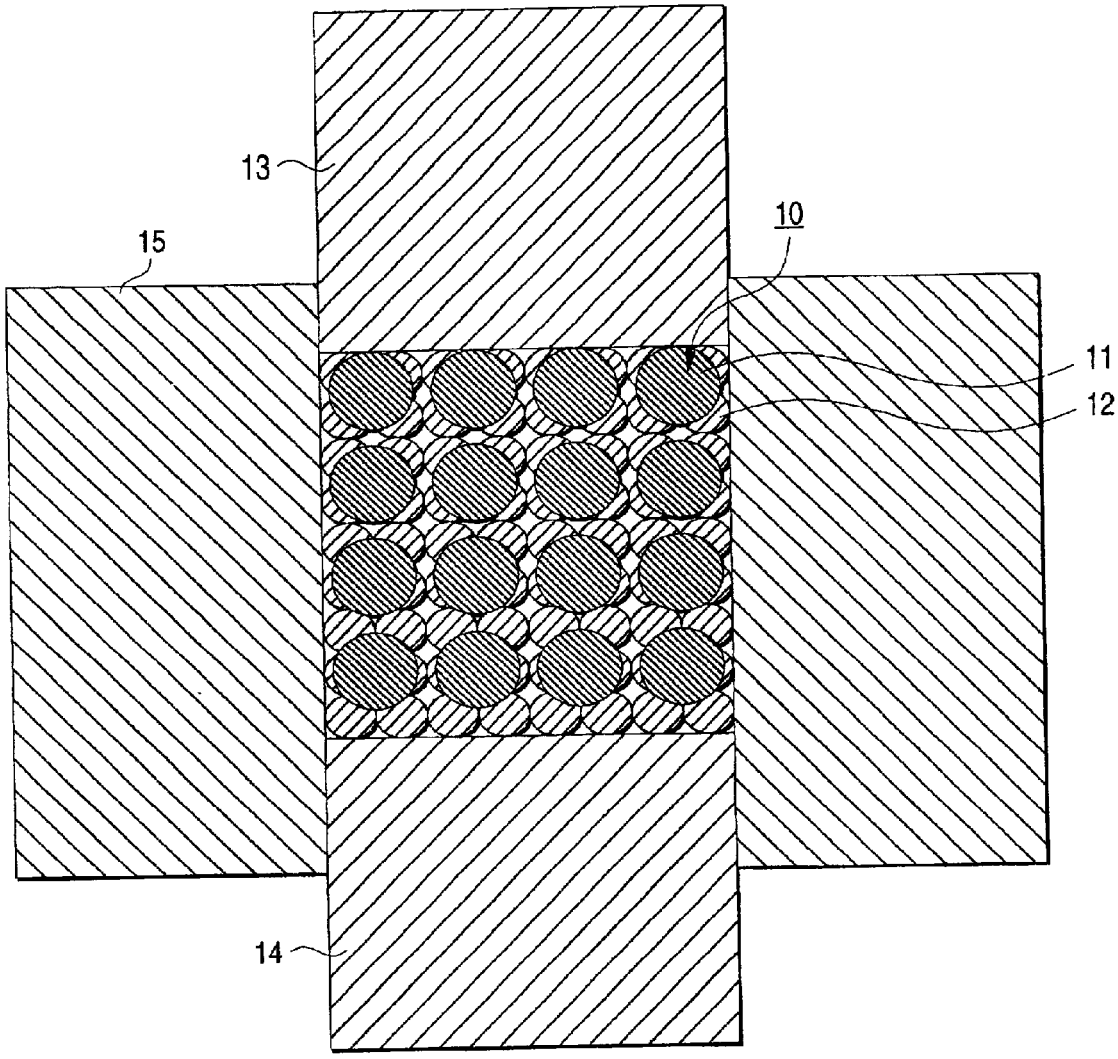
FIG. 1 is a sectional view to show the concept of a discharge surface treatment electrode and a manufacturing method thereof according embodiment 1 of the invention.

FIG. 1 is a sectional view to show the concept of a discharge surface treatment electrode and a manufacturing method thereof according embodiment 1 of the invention. In the figure, numeral 10 denotes a discharge surface treatment electrode, numeral 11 denotes WC (tungsten carbide) powder, numeral 12 denotes W (tungsten) powder, numeral 13 denotes an upper punch of a mold, numeral 14 denotes a lower punch of the mold, and numeral 15 denotes a mold die. The WC powder 11 and the W powder 12 are mixed and entered in the press mold and compressed and molded, thereby forming the discharge surface treatment electrode 10.

To enhance the hardness of a hard film formed on a workpiece, it is desirable that the component of the discharge surface treatment electrode should be only a material having comparatively high hardness such as carbide to make the film component of only a material having higher hardness, as previously described in Background of the Invention. Some material of the hard film formed on the workpiece may be poor in compatibility with the base material of the workpiece and a problem of weakening the adhesive strength of the hard film, etc., may occur. Thus, a material having good compatibility with the base material of the workpiece needs to be mixed in the discharge surface treatment electrode.

In the invention according to embodiment 1, to make the film component of only a material having higher hardness and provide good compatibility between the base material of the workpiece and the hard film formed on the workpiece, as discharge surface treatment electrode material, powder of hard metal carbide having higher hardness and powder of material contained in the base material of the workpiece and reacting with C (carbon) contained in work liquid to form the above-mentioned hard carbide are mixed and compressed and molded for forming a discharge surface treatment electrode.

Figure 2:
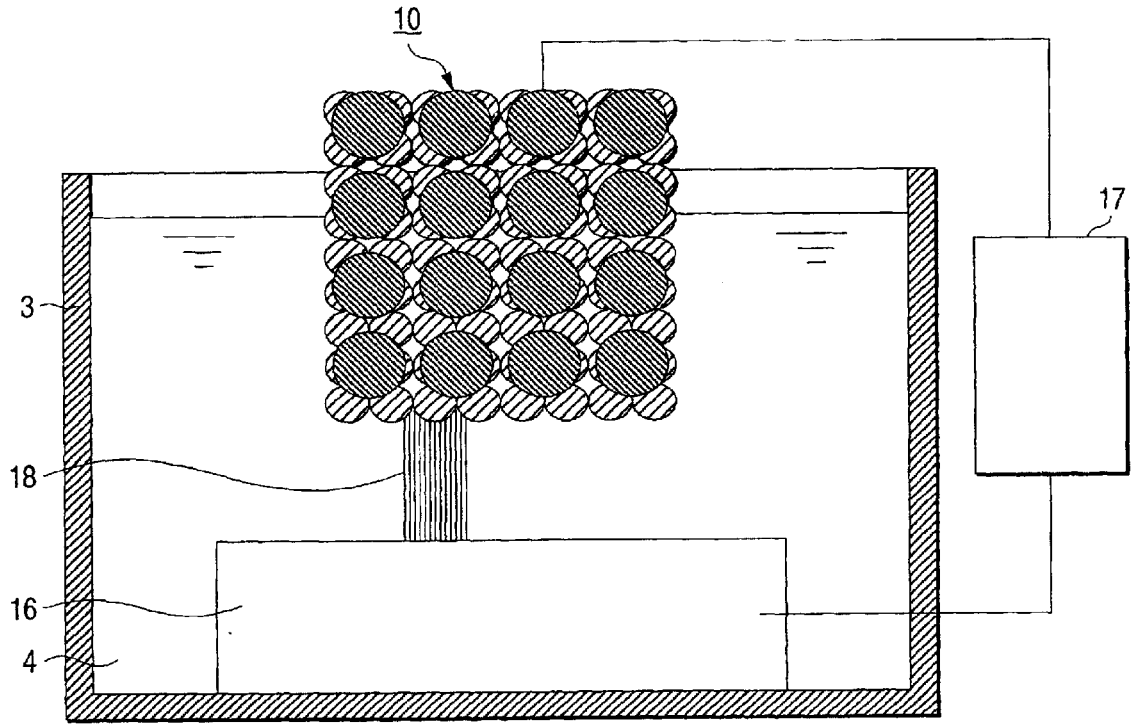
FIG. 2 is a drawing to show a discharge surface treatment method according to embodiment 1 of the invention.
Figure 3A:
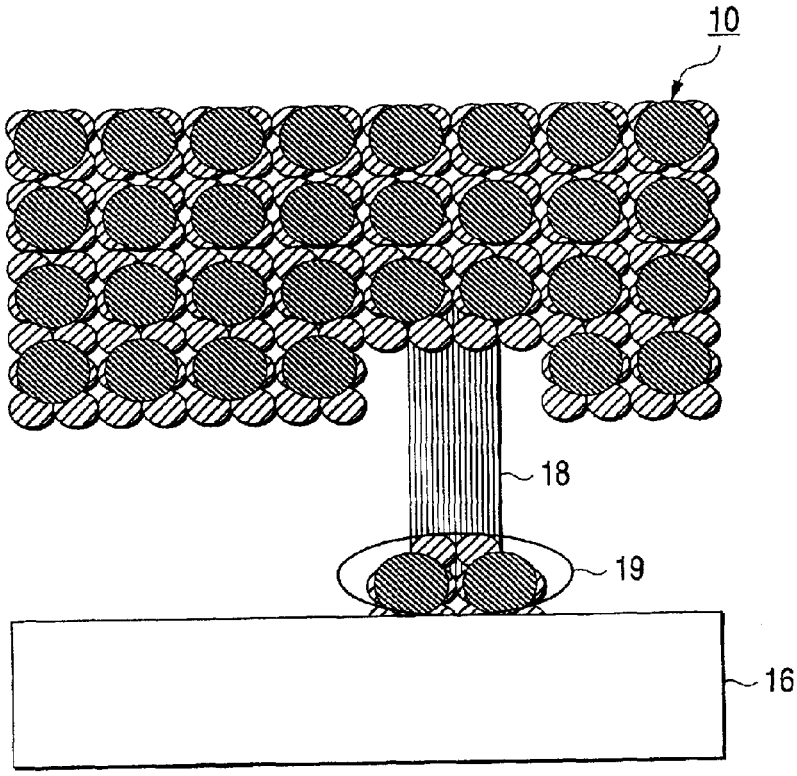
FIGS. 3A and 3B are schematic representations to show how a hard film is formed on a workpiece by the discharge surface treatment method according to embodiment 1 of the invention.
Figure 3B:
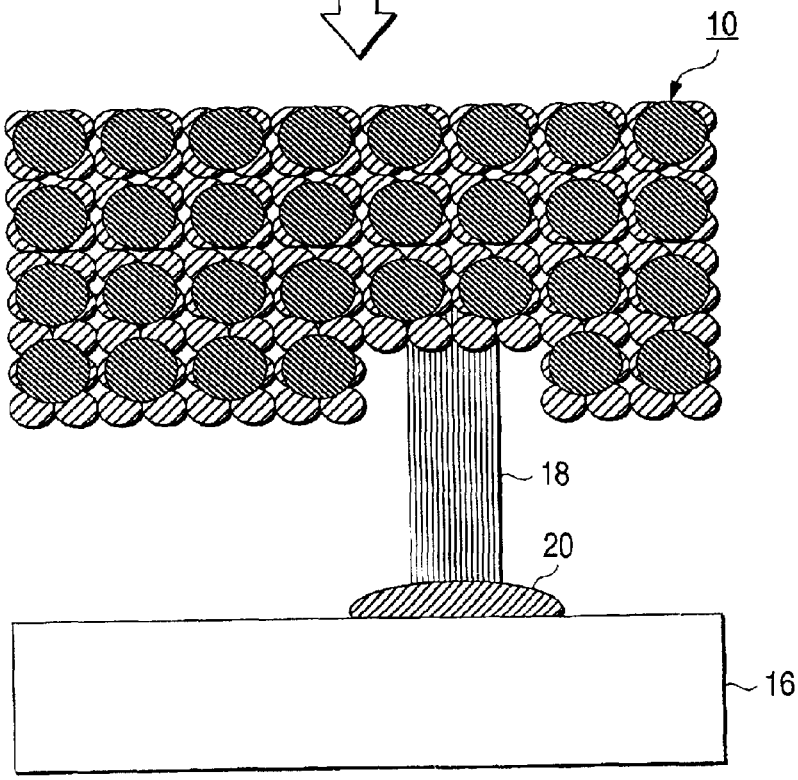

For example, the discharge surface treatment electrode 10 in FIG. 1 shows the case where a sintered hard alloy of a sintered material of WC and Co are the main materials of the workpiece. The hardness of the sintered hard alloy is HV=about 1300 to 2000 as microVickers hardness, because the whole hardness is degraded since soft Co is mixed although the hardness of WC is HV=about 2400. The discharge surface treatment electrode 10 in FIG. 1 consists of WC and W, and a film of only WC having higher hardness can be formed on the workpiece by discharge surface treatment using the electrode. WC is the same material as the component of the sintered hard alloy and thus has good compatibility with the sintered hard alloy of the base material and can provide strong adhesion. FIG. 2 shows a discharge surface treatment method according to embodiment 1 of the invention, and FIGS. 3A and 3B show how a hard film is formed on a workpiece by the discharge surface treatment method according to embodiment 1 of the invention. In the figures, numeral 3 denotes a work tank, numeral 4 denotes work liquid containing C as a component thereof, numeral 10 denotes a discharge surface treatment electrode consisting of WC and W, numeral 16 denotes a workpiece of a sintered hard alloy, numeral 17 denotes a discharge surface treatment power unit, numeral 18 denotes an arc electrode of discharge, numeral 19 denotes a discharge surface treatment electrode component melted by discharge heat and moved to the workpiece side, and numeral 20 denotes a hard film made of WC. When discharge occurs between the discharge surface treatment electrode 10 and the workpiece 16 by the discharge surface treatment power unit 17 in FIG. 2, the discharge surface treatment electrode 10 is melted by discharge heat and is emitted between electrodes and the discharge surface treatment electrode component 19 melted by discharge heat and moved to the workpiece side is deposited on the workpiece 16, as shown in FIG. 3A. Next, W of the component of the discharge surface treatment electrode 10 reacts with C of the component of the work liquid 4 to produce WC and together with WC of the component of the discharge surface treatment electrode 10 the hard film 20 made of WC is formed on the workpiece 16, as shown in FIG. 3B.

Figure 4:
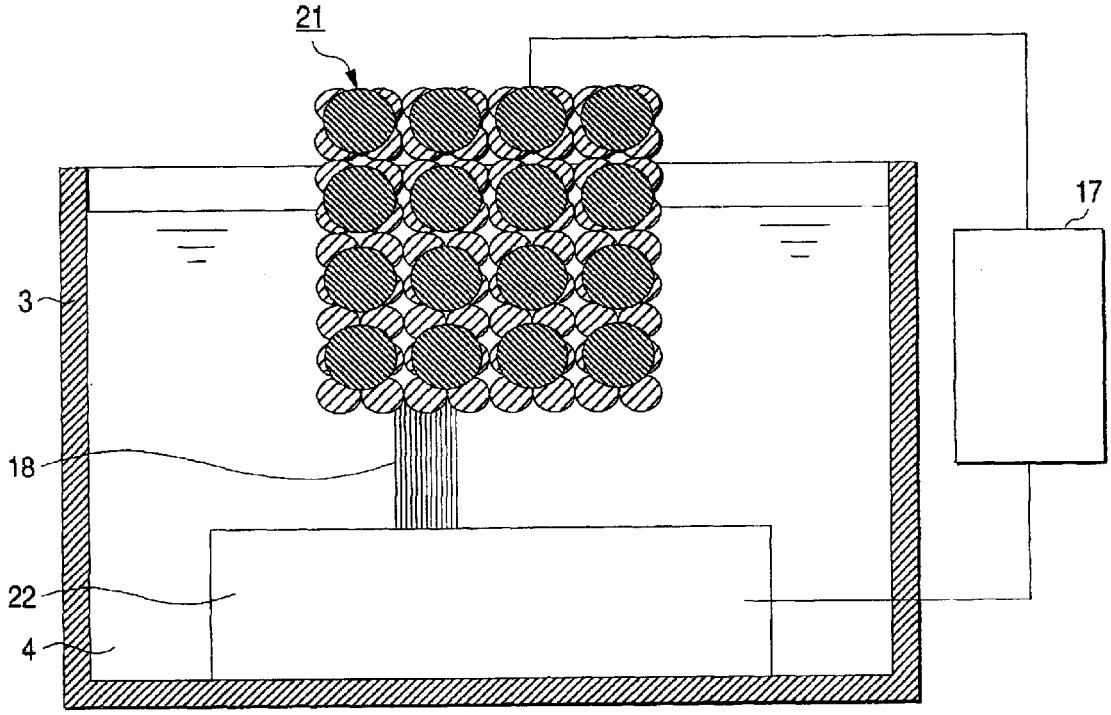
FIG. 4 is a schematic representation to show another example of the discharge surface treatment method according to embodiment 1 of the invention.

FIG. 4 shows another example of the discharge surface treatment method according to embodiment 1 of the invention; it shows the case where the workpiece is a steel material. In the figure, numeral 3 denotes a work tank, numeral 4 denotes work liquid containing C as a component thereof, numeral 17 denotes a discharge surface treatment power unit, numeral 18 denotes an arc electrode of discharge, numeral 21 denotes a discharge surface treatment electrode consisting of WC and Fe (iron), and numeral 22 denotes a workpiece of a steel material. Thus, to form a film on the workpiece 22 of a steel material, Fe of the base material of the workpiece 22 is mixed as a material of the discharge surface treatment electrode 21, whereby a film having strong adhesion can be formed. Embodiment 2.

Figure 5A:
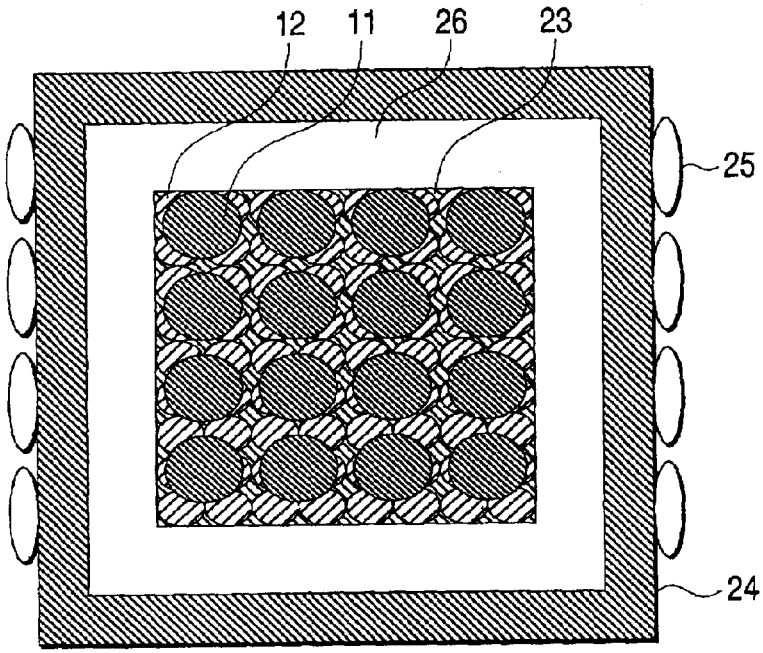
FIGS. 5A and 5B are schematic representations to show the concept of a manufacturing method of a discharge surface treatment electrode according to embodiment 2 of the invention.
Figure 5B:
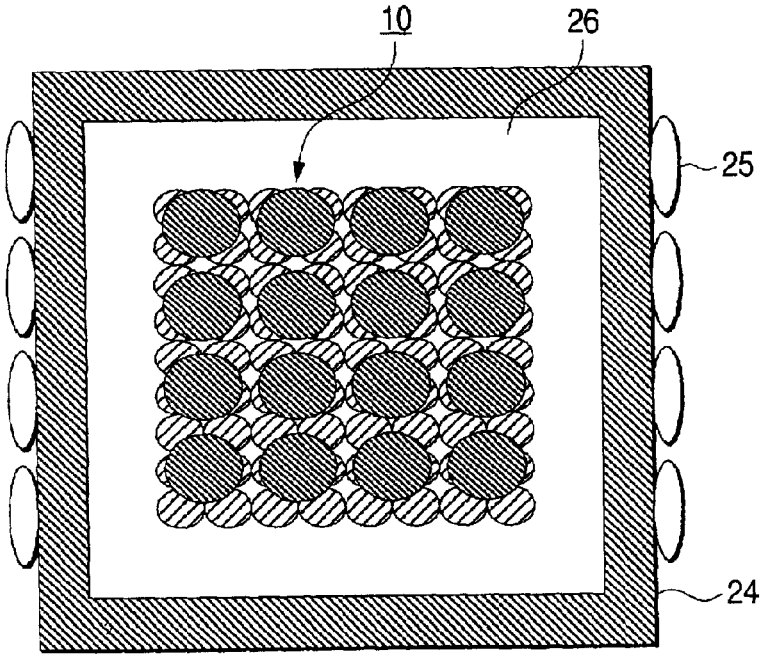
Figure 6:
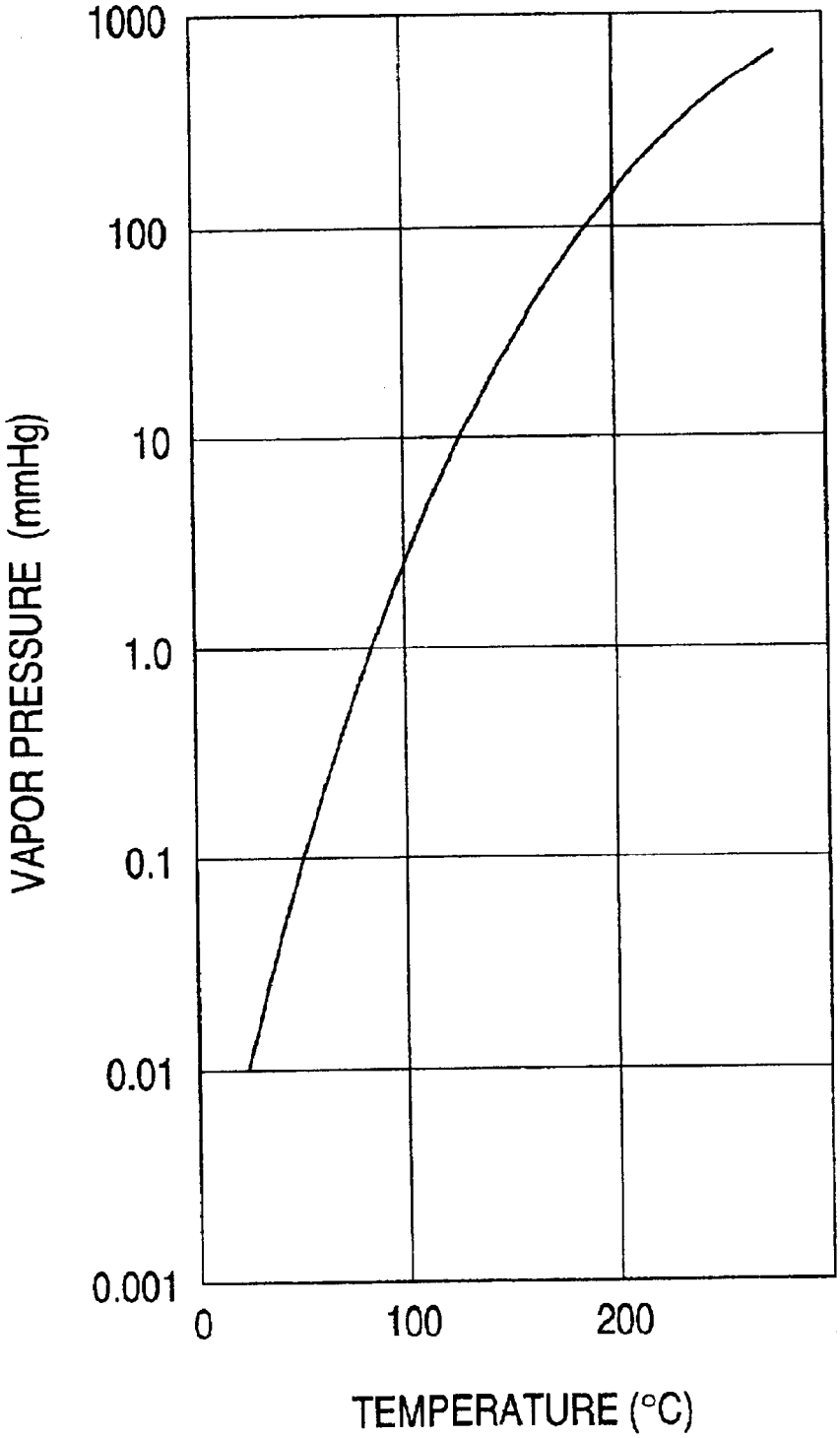
FIG. 6 is a drawing to show an example of a vapor pressure curve of wax mixed with discharge surface treatment electrode material at the compressing and molding time of the discharge surface treatment electrode according to embodiment 2 of the invention.
Figure 7:
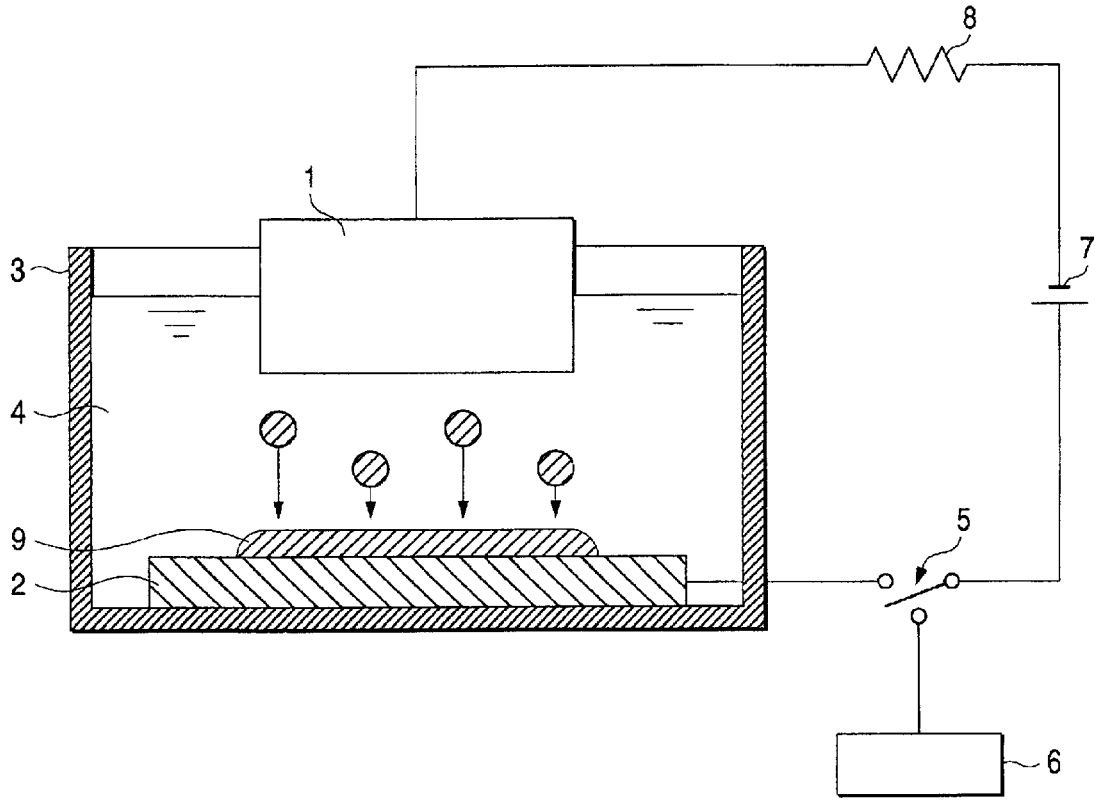
FIG. 7 is a drawing to show a configuration example of a discharge surface treatment electrode and an apparatus in a related art.

FIGS. 5A and 5B are drawings to show the concept of a manufacturing method of a discharge surface treatment electrode according to embodiment 2 of the invention. In the figure, numeral 10 denotes a discharge surface treatment electrode, numeral 11 denotes WC powder, numeral 12 denotes W powder, numeral 23 denotes wax such as paraffin, numeral 24 denotes a vacuum furnace, numeral 25 denotes a high-frequency coil, and numeral 26 denotes a vacuum atmosphere. The wax 23 is mixed with mixed powder of the WC powder 11 and the W powder 12 and they are compressed and molded to form a compacted powder electrode, whereby the mold property can be improved remarkably. However, since the wax 23 is an insulating substance, if it is left in the electrode in a large amount, the electric resistance of the electrode grows and thus the discharge property is worsened. Then, it becomes necessary to remove the wax 23. FIG. 5A shows how the compact powder electrode into which the wax 23 is mixed is entered in the vacuum furnace 21 and is heated. It is heated in the vacuum atmosphere 26, but may be heated in gas such as hydrogen or argon gas. The compacted powder electrode in the vacuum furnace 24 is high-frequency-heated by the high-frequency coil 25 installed surrounding the vacuum furnace 24. At this time, if the heating temperature is too low, the wax 23 cannot be removed; if the temperature is too high, the wax 23 becomes soot, degrading the purity of the electrode. Thus, it is necessary to keep the temperature at the temperature at which the wax 23 is melted or more and at the temperature at which the wax 23 decomposes to form soot or less. FIG. 6 shows a vapor pressure curve of wax having a boiling point of 250° C. as an example. If the atmospheric pressure of the vacuum furnace 24 is kept at the vapor pressure of the wax 23 or less, the wax 23 is evaporated and removed and the discharge surface treatment electrode 10 consisting of WC and W can be provided, as shown in FIG. 5B.

In the description given above, the discharge surface treatment electrode 10 consisting of WC and W and the discharge surface treatment electrode 21 consisting of WC and Fe have been explained, but any other material can be mixed into the discharge surface treatment electrode depending on the workpiece, of course. For example, if the workpiece is titanium metal, to form a hard film on the workpiece, a film having good compatibility with the base material of the workpiece can be formed by using TiC (titanium carbide) and Ti (titanium), TiC and TiO2 (titanium oxide), TiC and TiH2 (titanium hydride), or the like in combination.

INDUSTRIAL APPLICABILITY

As described above, the discharge surface treatment electrode and the manufacturing method thereof and the discharge surface treatment method according to the invention are suited for use as industries involving surface treatment for forming a hard film on the surface of a workpiece.

What is claimed is:

1. A discharge surface treatment electrode used for discharge surface treatment of causing discharge to occur between said electrode and a workpiece in work liquid containing carbon and forming a hard film containing metal carbide as a component on a surface of the workpiece by discharge energy, characterized in that the above metal carbide and metal contained in the metal carbide or a compound of that metal or any other metal forming a hard carbide or a compound of that metal are contained as material of said discharge surface treatment electrode.

2. The discharge surface treatment electrode as claimed in claim 1 wherein the metal carbide is metal carbide of metal or a metal compound contained in material of the workpiece.

3. The discharge surface treatment electrode as claimed in claim 2 wherein the material of said discharge surface treatment electrode contains WC and W.

4. A manufacturing method of a discharge surface treatment electrode used for discharge surface treatment causing discharge to occur between said electrode and a workpiece in work liquid containing carbon and forming a hard film containing metal carbide as a component on the surface of the workpiece by discharge energy, characterized in that powder of the metal carbide and powder of the metal contained in the metal carbide or powder of a compound of the metal or powder of any other metal forming a hard carbide or powder of a compound of that metal are mixed and are compressed and molded to form the discharge surface treatment electrode.

5. The manufacturing method of a discharge surface treatment electrode as claimed in claim 4 wherein wax is added to the material of the discharge surface treatment electrode and then they are compressed and molded and are heated at a temperature at which the wax is melted or more and at a temperature at which the wax is decomposed to produce soot or less, for evaporating and removing the wax to form the discharge surface treatment electrode.

6. A discharge surface treatment method for causing discharge to occur between a discharge surface treatment electrode and a workpiece in work liquid containing carbon and forming a hard film containing metal carbide as a component on a surface of the workpiece by discharge energy, characterized in that the discharge surface treatment electrode containing the metal carbide and metal contained in the metal carbide or a compound of the metal or any other metal forming hard carbide or a compound of the metal is used.

7. The discharge surface treatment method as claimed in claim 6 wherein the metal carbide is metal carbide of metal or a metal compound contained in material of the workpiece.

* * * * *